United States Patent [19]

Woods et al.

[11] Patent Number: 4,980,008

[45] Date of Patent: Dec. 25, 1990

[54] METHOD FOR DECORATING CYLINDRICAL, METALLIC CONTAINERS

[75] Inventors: Jack L. Woods, Ogden; J. Mason Kirton, Woods Cross, both of Utah

[73] Assignee: Ball Corporation, Westminster, Colo.

[21] Appl. No.: 380,323

[22] Filed: Jul. 17, 1989

[51] Int. Cl.[5] ..... B44C 1/165

[52] U.S. Cl. ..... 156/230; 156/241; 156/583.3; 100/211

[58] Field of Search ..... 156/295, 581, 583.3, 156/230, 240, 241, 323, 287, 475, 580; 100/211, 212; 425/389, 440; 8/471

[56] References Cited

U.S. PATENT DOCUMENTS

| | | | |
|---|---|---|---|
| 1,782,852 | 11/1930 | Jeffray | 100/211 |
| 4,465,489 | 8/1984 | Jenkins et al. | 8/471 |
| 4,541,891 | 9/1985 | leatherman | 156/285 |
| 4,651,638 | 3/1987 | Duchamp et al. | 100/211 |
| 4,874,454 | 10/1989 | Talalay et al. | 156/240 |

*Primary Examiner*—Michael. W. Ball
*Assistant Examiner*—Chester T. Barry
*Attorney, Agent, or Firm*—Terry M. Crellin

[57] ABSTRACT

A method and apparatus for decorating the exterior surface of a cylindrical member such as a food or beverage can. A cylindrical bladder made of an elastomeric material is mounted longitudinally within a rigid support so as to create a closed cavity between the support and the bladder. At least a partial vacuum is created in the cavity through a port in the support. The vacuum extends the sidewall of the bladder making room for positioning of a transfer sheet containing sublimable dyes around the cylindrical member within the extended bladder. Vacuum is broken by admitting gas into the cavity at atmospheric pressure. The bladder sidewall contracts radially inwardly thus securely contacting the transfer sheet against the cylindrical member. Heat is applied to transfer at least a portion of the dyes to the cylindrical member. the transfer sheet and cylindrcial member are then removed from the bladder.

10 Claims, 1 Drawing Sheet

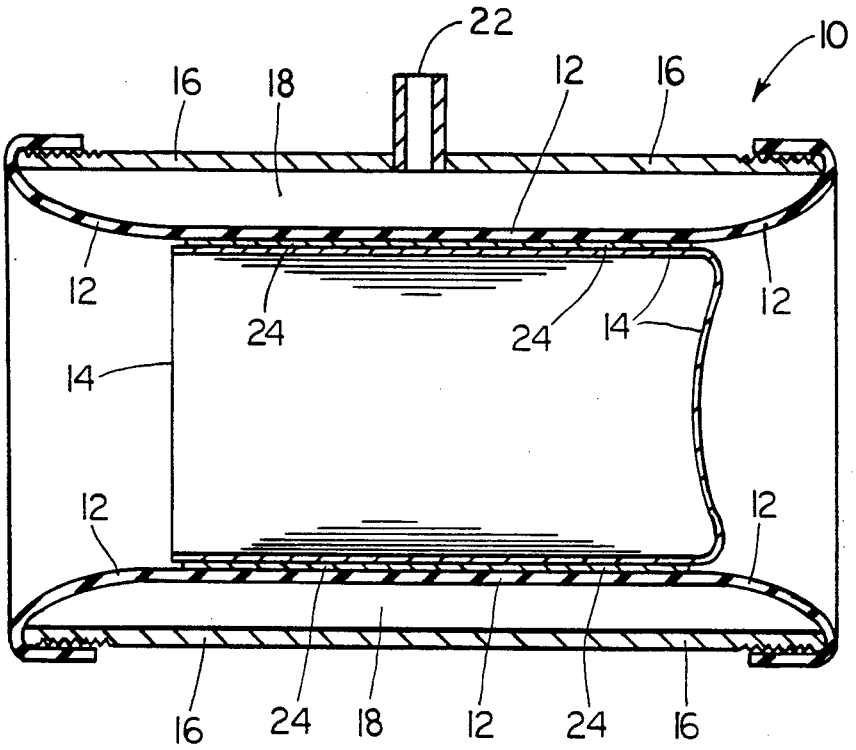
22
10
16
18
12
16
12
24
24
14
12
14
12
12
16
24
18
12
24
16

METHOD FOR DECORATING CYLINDRICAL, METALLIC CONTAINERS

BACKGROUND OF THE INVENTION

1. Field of the Invention

The present invention relates generally to methods of decorating cylindrical objects or items that can be supported on a cylindrical objects, wherein a heat transfer sheet comprising sublimable dyes is used in transferring desired images or other decorations to the cylindrical objects or other items supported on the cylindrical objects. The present invention relates in particular to methods of decorating metal cans used in the beverage and food packaging industries.

2. State of the Art

The use of heat transfer sheets which contain sublimable dyes for transfer of images and patterns to a substrate on which the heat transfer sheets are in contact is well known in the prior art. The image can be transferred from the transfer sheet to numerous substrate materials including anodized aluminum, plastic materials and textile fabrics. The transfer sheet must be held in contact with the item to be decorated while the transfer sheet is heated. The sublimable dyes pass from the transfer sheet to the item to be decorated and are absorbed or adsorbed on the surface of the item. Heretofore, the process has commonly involved a heated platen. The item to be decorated is placed on a base support, and the transfer sheet is placed over the item in contact therewith. The heated platen is then pressed down on the transfer sheet to heat the sublimable dyes and drive the dyes into the surface of the item being decorated.

Decoration of cans used as beverage and food containers has heretofore involved complex, expensive printing equipment. A coating of plastic material is usually applied to the external surface of the can and the can then passes through a complex machine to have the decoration applied to the base coating. The equipment used is prone to malfunction and requires almost constant fine tuning of the mechanism for conveying and printing the images on the cans. The equipment used in forming the cans and applying the base coating of plastic material to the outside of the cans is much more reliable than the printing machines. It would be highly desirable to develop a process for printing the designs on the cans which is as reliable as the process for forming the cans so that the printing step is not a bottle neck forcing unnecessary shutdowns of the can forming process.

3. Objectives

A principal objective of the invention is to provide a novel, method of printing designs on cylindrical items such as cans used in the beverage and food industries, wherein the method comprises heat transfer printing of designs to the surface of the cylindrical items.

An additional objective of the invention is to provide such a method of printing designs on cylindrical items wherein separate, individual casings are readily applied to respective items to be decorated to hold the heat transfer sheet in contact with the surface of the item to be decorated.

Another objective of the invention is to provide an economical, reliable method of printing designs on cylindrical items wherein the method utilizes reliable mechanical apparatus which requires minimal maintenance and virtually no fine tuning as is required by conventional apparatus used in printing designs on cylindrical items such as cans.

BRIEF DESCRIPTION OF THE INVENTION

The above objectives are achieved in accordance with the present invention by providing a novel, unique method of decorating the surface of cylindrical items, wherein the cylindrical items are placed in individual casings which maintain a heat transfer printing sheet in intimate contact with the surface of the cylindrical item. The casings are then transferred through a heating apparatus in which the heat transfer sheet is heated to transfer the design from the heat transfer sheet to the surface of the cylindrical items.

The novel method of the invention comprises positioning a cylindrical bladder made of a resilient, elastomeric material within a rigid cylindrical support member. The opposite ends of the cylindrical bladder are extended radially outwardly and attached to the respective ends of the rigid support member so as to create a closed cavity between the longitudinal sidewall of the bladder and the rigid support member, with the opposite ends of the bladder itself being open.

A port is provided in the rigid support member, with the port being in fluid flow communication with the cavity formed between the bladder and the rigid support member. At least a partial vacuum is created in the cavity between the bladder and the rigid support member by evacuating gas from the cavity through the port in the side of the rigid support member. The partial vacuum uniformly extends the longitudinal sidewall of the cylindrical bladder such that the diameter of the extended bladder is at least as large as the external diameter of the cylindrical member which is to be decorated.

The cylindrical member is positioned longitudinally within the expanded bladder, and a heat transfer sheet containing the design which is to be transferred to the cylindrical member is positioned about the external surface of the cylindrical member so that the transfer sheet lies flatwise around the external surface of the cylindrical member and is sandwiched between the cylindrical member and the bladder. Gas is then admitted to the cavity between the bladder and the support member through the port in the support member. This produces an essentially atmospheric pressure within the cavity, and the longitudinal sidewall of said bladder contracts radially inwardly until it makes uniform contact with the transfer sheet on the surface of said cylindrical member to hold the transfer sheet in a stable, firm position on the surface of the cylindrical member and to simultaneously support the cylindrical member within the bladder.

While the transfer sheet is being held in stable, firm contact with the surface of the cylindrical member by the bladder, the transfer sheet is heated to a temperature sufficient to transfer at least a portion of the dye or coloring agent from the transfer sheet to the surface of the cylindrical member to decorate the surface of the cylindrical member. The transfer sheet and the decorated cylindrical member are then removed from the bladder.

The apparatus used in handling the casings both in positioning the item to be decorated and the heat transfer sheet within the casing and of heating the heat transfer sheet to transfer the design thereon to the item to be decorated is relatively simple in mechanical structure and operation. The apparatus is highly reliable and there is no fine tuning required to maintain proper operation of the apparatus. The printing stage of a production line for the production of decorated, cylindrical items such as food and beverage cans can readily be designed to match the item forming stage of the production line, and the printing stage is no longer a bottle neck which can force unnecessary shutdowns of the item forming stage of the production line.

Additional objects and features of the invention will become apparent from the following detailed description, taken together with the accompanying drawings.

THE DRAWING

The single FIGURE of the drawings shows a cross section of a typical casing used in practicing the method of the invention.

DETAILED DESCRIPTION OF THE PREFERRED EMBODIMENTS

In the drawing a typical casing or canister unit 10 is illustrated which is useful in the method for decorating the exterior surface of a cylindrical member in accordance with the present invention. The canister unit 10 is provided with a cylindrical bladder 12 which is made of a resilient, elastomeric material. The internal diameter of the bladder in its normal, unextended condition is smaller than the external diameter of the cylindrical item, such as an aluminum can blank 14, which is to be decorated. The bladder 12 is mounted longitudinally within a rigid support member 16, with the opposite ends of the cylindrical bladder 12 being extended radially outwardly and attached to the rigid support member 16 so as to create a closed cavity 18 between the longitudinal sidewall of the bladder 12 and the rigid support member 16. The opposite ends of the bladder 12, of course, are open. The support member 16 is preferably made of a metal such as aluminum.

A port 22 is provided in the rigid support member 16, with the port 22 being in fluid flow communication with the cavity 18. In accordance with the method of the present invention, at least a partial vacuum is created in the cavity 18 by evacuating gas from the cavity 18 through the port 22. The partial vacuum formed in the cavity 18 uniformly extends the longitudinal sidewall of the cylindrical bladder 12 and draws the sidewall toward the rigid support member 16 such that the diameter of the extended bladder 12 is at least as large as the external diameter of the cylindrical member which is to be decorated.

Following the enlargement of the bladder 12, the cylindrical member, such as can 14, is positioned longitudinally within the expanded bladder 12, with the external surface of the can 14 being received essentially coaxially within the expanded bladder 12. A heat transfer sheet 24 containing the desired design thereon formed from sublimable dyes or coloring agents is positioned about the external surface of the can 14 so that the transfer sheet 24 lies flatwise around the external surface of the can 14 and is sandwiched between the can 14 and the bladder 12. It is advantageous to wrap the heat transfer sheet 24 about the cylindrical member or can 14 previous to insertion of the cylindrical member into the enlarged bladder 12. The transfer sheet 24 is temporarily secured to the cylindrical member before being inserted into the bladder 12 to facilitate such insertion.

Following proper positioning of the cylindrical member or can 14 and the heat transfer sheet 24 within the canister unit 10, gas is admitted to the cavity 18 through the port 22 so as to produce an essentially atmospheric pressure within the cavity 18. This allows the longitudinal sidewall of the bladder 12 to contract radially inwardly until it makes uniform contact with the transfer sheet 24 on the surface of the can 14. The transfer sheet 24 is thus held in a stable, firm position on the surface of the can 14, and the can 14 is simultaneously supported within the bladder 12.

While the transfer sheet is being held in stable, firm contact with the surface of the can 14 by the bladder 12, the transfer sheet 24 is heated to a temperature sufficient to transfer at least a portion of the dyes or coloring agents from the transfer sheet 24 to the surface of the can 14 to decorate the surface of the can. Heating of the interior of the can 14 is advantageously performed by admitting heated air into the interior of the can. Inasmuch as the can 14 is in the form of a blank and has not been sealed with a top, the can 14 is open at one end and heated air can readily be directed to the inside of the can 14.

Following transfer of the design from the transfer sheet 24 to the can 14, the transfer sheet 24 and the decorated can 14 are removed from the bladder 12. Evacuation of at least a portion of the air in the cavity 18 so as to expand the bladder 12 can be done to aid in the removal of the decorated can 14 from the bladder 12.

The method of the present invention is advantageously used to decorate the exterior surfaces of a variety of cylindrical members. The method is highly useful in decorating metal items such as cans used in the packaging of foods and beverages. In particular, it is advantageous to use the method in decorating aluminum cans used in packaging beverages. The exterior surface of the aluminum cans or any other cylindrical items which are to be decorated can advantageously be coated with a coating which is receptive to the transfer of a sublimable dyes or coloring agents.

The rigid, member 16 is, of course, hollow and has a tubular sidewall. The support member 16 must be made of a material which is capable of withstanding temperatures up to 200° C., with the tubular sidewall having a minimum cross-sectional clearance of at least about 6 centimeters. The support member 16 is preferably made of a metal such as aluminum.

The cylindrical bladder 12 is made of a resilient, elastomeric material capable of withstanding temperatures up to 200° C. Preferably, the bladder 12 is made of silicone rubber. The bladder 12 has an outer diameter in its normal, unextended condition which is at least about one centimeter less than the internal clearance or diameter of the support member 16. The wall thickness of the bladder 12 is preferably between about 0.5 millimeter and 3 millimeters.

The opposite ends of the bladder 12 are preferably expanded radially outwardly and attached to the opposite ends of the support member 16 to create the closed cavity 18 between the longitudinal sidewall of the bladder 12 and the support member 16. The bladder 12 preferably comprises an elongate, tubular piece of elastomeric material which has a longitudinal length substantially greater than the longitudinal length of the support member 16, and the opposite ends of the tubular piece are expanded radially outwardly and attached to the opposite ends of the support member 16 by being folded back over the exterior surface of the support member 16. A series of ridges and valleys can be formed in the surfaces immediately adjacent to the opposite ends of the support member 16, with the ridges and valleys forming frictional surfaces for the respective, folded back ends of the bladder 12.

Although preferred embodiments of the method and apparatus of the present invention have been illustrated and described, it is to be understood that the present disclosure is made by way of example and that various other embodiments are possible without departing from the subject matter coming within the scope of the following claims, which subject matter is regarded as the invention.

What we claim is:

1. A method for decorating the exterior surface of a cylindrical member whose surface is receptive to the transfer of a sublimable dye or coloring agent, said method comprising;

providing a cylindrical bladder made of a resilient, elastomeric material, with the internal diameter of said bladder in its normal, unextended condition being smaller than the external diameter of the cylindrical member which is to be decorated, said bladder being mounted longitudinally within a rigid support member, with the opposite ends of the cylindrical bladder being extended radially outwardly and attached to the rigid support member so as to create a closed cavity between the longitudinal sidewall of the bladder and the rigid support member, with the opposite ends of the bladder itself being open;

providing a port in the rigid support member which is in fluid flow communication with the cavity formed between said bladder and said rigid support member;

creating at least a partial vacuum in the cavity between the cylindrical bladder and the rigid support member by evacuating gas from said cavity through said port in the side of said rigid support member, wherein the partial vacuum formed in said cavity uniformly extends the longitudinal sidewall of the cylindrical bladder such that the diameter of the extended bladder is at least as large as the external diameter of the cylindrical member which is to be decorated;

positioning the cylindrical member longitudinally within the expanded bladder, such that the external surface of said cylindrical member is received essentially coaxially within said expanded bladder;

positioning a transfer sheet containing the sublimable dye or coloring agent about the external surface of the cylindrical member so that the transfer sheet lies flatwise around the external surface of said cylindrical member and is sandwiched between the cylindrical member and the bladder;

admitting gas to said cavity through the port of said rigid support member so as to produce an essentially atmospheric pressure within said cavity, whereby the longitudinal sidewall of said bladder contracts radially inwardly until it makes uniform contact with the transfer sheet on the surface of said cylindrical member to hold the transfer sheet in a stable, firm position on the surface of said cylindrical member and to simultaneously support the cylindrical member within said bladder;

while the transfer sheet is being held in stable, firm contact with the surface of the cylindrical member by the bladder, heating the transfer sheet to a temperature sufficient to transfer at least a portion of the dye or coloring agent from the transfer sheet to the surface of the cylindrical member to decorate the surface of the cylindrical member; and removing the transfer sheet and the cylindrical member having the decorated surface from the bladder.

2. A method for decorating the exterior surface of a cylindrical member in accordance with claim 1, wherein the cylindrical member is made of metal.

3. A method for decorating the exterior surface of a cylindrical member in accordance with claim 2, wherein the cylindrical member is made of aluminum.

4. A method for decorating the exterior surface of a cylindrical member in accordance with claim 1, wherein the cylindrical member is a container for use in packaging foods or beverages.

5. A method for decorating the exterior surface of a cylindrical container in accordance with claim 4, wherein the cylindrical container is made of metal.

6. A method for decorating the exterior surface of a cylindrical container in accordance with claim 4, wherein the cylindrical container is made of aluminum.

7. A method for decorating the exterior surface of a cylindrical container in accordance with claim 1, wherein the bladder is made of silicone rubber.

8. A method for decorating the exterior surface of a cylindrical container in accordance with claim 1, wherein the transfer sheet is wrapped about the exterior surface of the cylindrical member and temporaily secured to the cylindrical member berfore the cylindrical member is positioned within the expanded bladder.

9. A method for decorating the exterior surface of a cylindrical member in accordance with claim 1, wherein the cylindrical member is an aluminum container which is to be used in packaging beverages.

10. A method for decorating the exterior surface of a beverage container in accordance with claim 9, wherein the external surface of the aluminum beverage container comprises a coating which is receptive to the transfer of a sublimable dye or coloring agent.

* * * * *